US008684394B2

(12) United States Patent
Smith

(10) Patent No.: US 8,684,394 B2
(45) Date of Patent: Apr. 1, 2014

(54) REMOTELY CONTROLLED SNOW BOARD BINDING

(71) Applicant: Mitchell S Smith, Phoenix, AZ (US)

(72) Inventor: Mitchell S Smith, Phoenix, AZ (US)

( * ) Notice: Subject to any disclaimer, the term of this patent is extended or adjusted under 35 U.S.C. 154(b) by 0 days.

(21) Appl. No.: 13/694,303

(22) Filed: Nov. 16, 2012

(65) Prior Publication Data

US 2013/0328288 A1 Dec. 12, 2013

Related U.S. Application Data

(60) Provisional application No. 61/629,374, filed on Nov. 17, 2011.

(51) Int. Cl.
*A63C 10/00* (2012.01)
*A63C 9/088* (2012.01)

(52) U.S. Cl.
USPC ..... 280/617; 280/634; 280/14.22

(58) Field of Classification Search
CPC ..... A63C 9/088; A63C 9/0885
USPC ..... 280/611, 617, 618, 619, 620, 623, 633, 280/634, 11.36, 14.22, 14.23, 14.24

See application file for complete search history.

(56) References Cited

U.S. PATENT DOCUMENTS

| | | | | |
|---|---|---|---|---|
| 3,892,980 | A * | 7/1975 | Anderson | 307/116 |
| 4,361,344 | A * | 11/1982 | Hull et al. | 280/613 |
| 5,190,311 | A * | 3/1993 | Carpenter et al. | 280/618 |
| 5,362,087 | A * | 11/1994 | Agid | 280/611 |
| 6,659,494 | B1 * | 12/2003 | Martin | 280/612 |
| 7,063,345 | B2 * | 6/2006 | Holzer | 280/611 |
| 2007/0170696 | A1 * | 7/2007 | Damiani et al. | 280/617 |
| 2009/0243259 | A1 * | 10/2009 | De La Torre Rodriguez | 280/618 |

* cited by examiner

*Primary Examiner* — Frank Vanamann
(74) *Attorney, Agent, or Firm* — Tod R. Nissle, P.C.

(57) ABSTRACT

A snow board comprises an elongate board and at least one binding mounted transverse the longitudinal axis of the board. The binding includes an anchor pivotally mounted on the binding. The anchor moves between two operative positions to lock, and then release, the heel of a boot in the binding. A motor assembly increases and decreases the tension in a cable to move the anchor between the two operative positions. The motor assembly is remotely controlled.

1 Claim, 7 Drawing Sheets

*FIG. 1: Prior Art*

FIG. 2: Prior Art

REMOTELY CONTROLLED SNOW BOARD BINDING

CROSS-REFERENCE TO RELATED APPLICATIONS

This application claims priority based on provisional patent application Ser. No. 61/629,374, filed Nov. 17, 2011.

STATEMENT REGARDING FEDERALLY SPONSORED RESEARCH OR DEVELOPMENT

Not Applicable.

THE NAMES OF PARTIES TO A JOINT RESEARCH OR DEVELOPMENT

Not Applicable.

INCORPORATION-BY-REFERENCE OF MATERIAL SUBMITTED ON A COMPACT DISC

Not Applicable.

SEQUENCE LISTING

Not Applicable.

BACKGROUND OF THE INVENTION (1) Field of the Invention

This invention relates to snow boards.

More particularly, the invention relates to a snow board binding which facilitates the insertion and removal by an individual of a snow board boot in the binding.

(2) Description of Related Art Including Information Disclosed Under 37 CFR 1.97 and 1.98

Several well known manufacturers of snow board bindings are K2™, Burton™, and Flow™. Such manufacturers and others of skill in the art have for many years endeavored to improve the construction and functioning of snow board bindings. It continues to be highly desirable to improve the construction and operation of snow board bindings.

Therefore, it is a principal object of the invention to provide an improved snow board binding.

BRIEF DESCRIPTION OF THE SEVERAL VIEWS OF THE DRAWINGS

This, and other and further objects of the invention will be apparent from the following detailed description thereof, taken in conjunction with the drawings in which.

BRIEF SUMMARY OF THE INVENTION

Briefly, provided is an improved snow board. The snow board comprises an elongate board shaped and dimensioned to slide over snow and having a longitudinal axis; and, at least one binding mounted transverse the longitudinal axis. The binding includes a base; a first strap attached to the base and shaped and dimensioned to extend over and secure the toe of a boot worn by an individual; a second strap attached to the base and shaped and dimensioned to extend over and secure the instep of a boot worn by an individual; and, a heel anchor pivotally connected to the base and having at least two operative positions, a first operative locking position securing in the binding the heel of a snow board boot worn by an individual, and a second operative release position permitting the heel of a snow board boot worn by an individual to be removed from the binding. The binding also includes a generally U-shaped cable including an intermediate portion and including a pair of ends each pivotally connected to the base; and, includes control apparatus fixedly mounted on the heel anchor to engage the cable and move the cable between at least two operative positions, a primary upwardly displaced operative position to move pivotally the heel anchor to the first operative locking position, and a secondary downwardly displaced operative position to move pivotally the heel anchor to the second operative release position. The control apparatus includes a displacement member engaging the intermediate portion of the cable and includes apparatus to move the displacement member toward and away from the base of the binding.

DETAILED DESCRIPTION OF THE INVENTION

Figure 1:
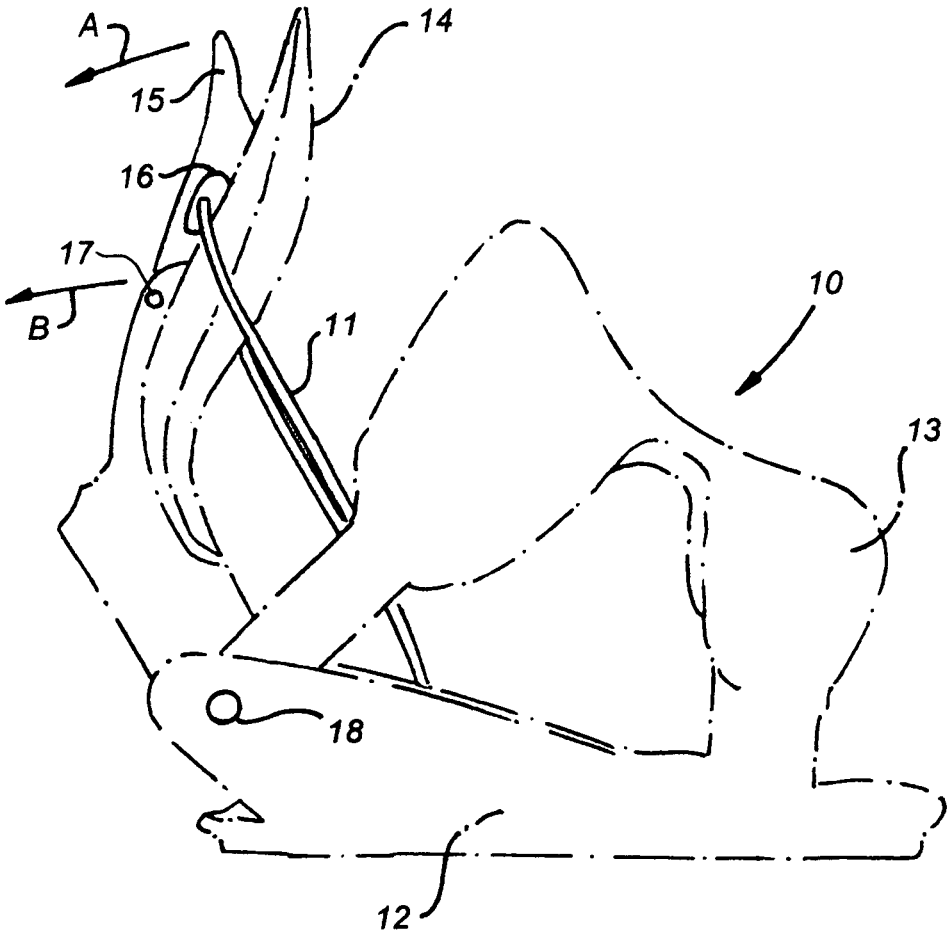
FIG. 1 is a side view illustrating a conventional snow board binding and the mode of operation thereof.
Figure 2:
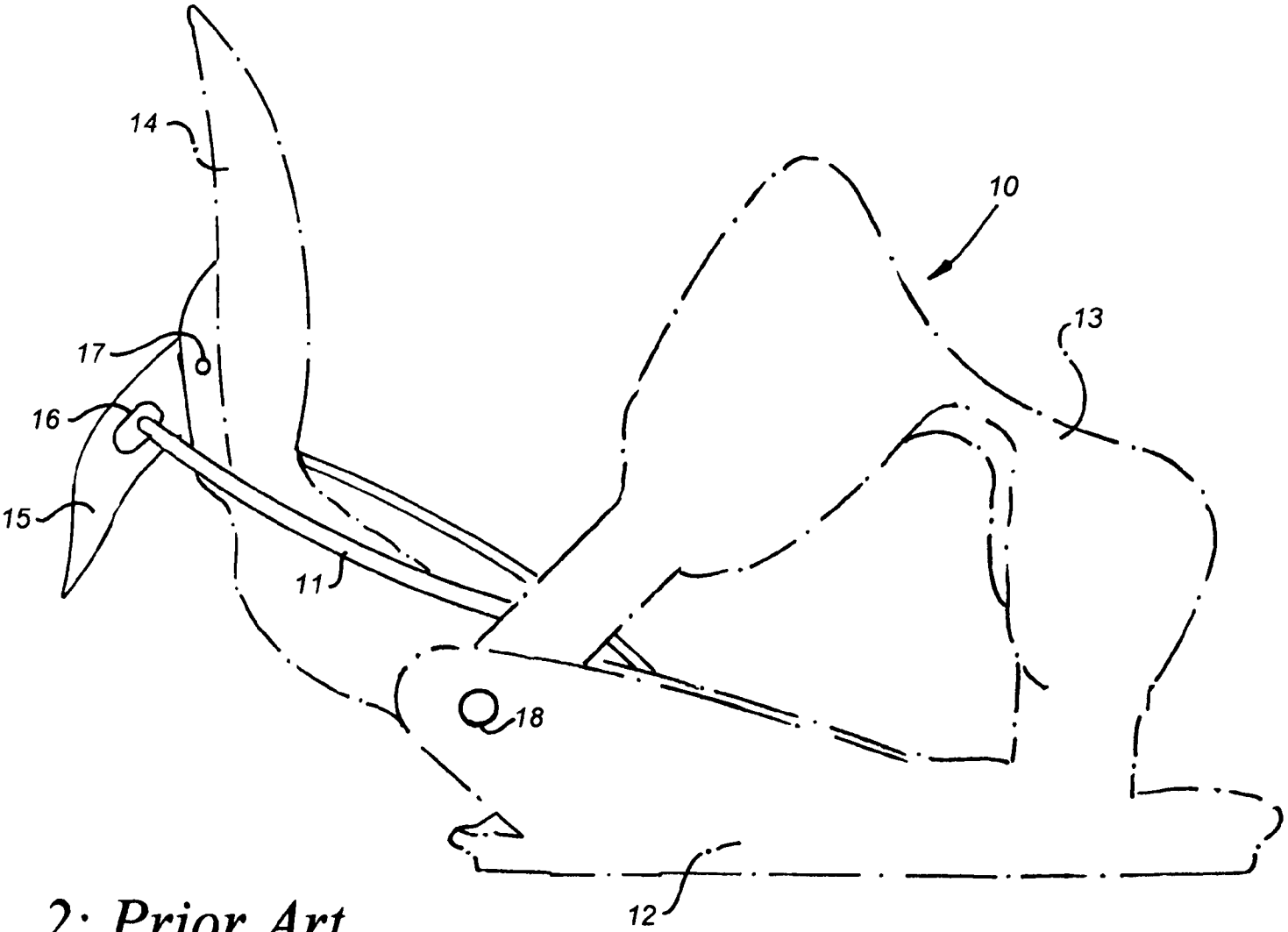
FIG. 2 is a side view of the snow board binding of FIG. 1 further illustrating the mode of operation thereof.

Turning now to the drawings which depict the presently preferred embodiments by way of illustration and not limitation of the invention and in which like reference characters refer to corresponding elements throughout the several views, FIGS. 1 and 2 illustrate a prior art binding 10. Binding 10 includes a base 12, toe and instep strap 13, and heel brace 14. The lower end of brace 14 is pivotally connected to base 12 by a pin 18. The lower ends (not visible) of U-shaped wire member 11 are pivotally secured to base 12 in conventional fashion. Wire member 11 has the general shape of an inverted U. The upper arcuate end of member 11 extends through an opening 16 formed through latch 15. The lower end of latch 15 is pivotally secured to brace 14 by pin 17. Brace 14 moves between two operative positions, the closed operative position illustrated in FIG. 1, and the open operative position illustrated in FIG. 2. When brace 14 is in the closed operative position and a snow boarder's boot is mounted in binding 10, wire 11 is tensioned and brace 14 secures the heel of the boot in the binding. When brace 14 is in the open operative position of FIG. 2, a snow boarder can readily insert and remove his boot from binding 10.

In operation of brace 14, when brace 14 is in the closed operative position of FIG. 1, latch 15 is pivoted about pin 17 in the direction indicated by arrow A. This downwardly displaces latch 15 in the direction of arrow A, and also pivots wire member 11 in the direction of arrow A and causes brace 14 to pivot about pin 18 in the direction of arrow B. Pivoting latch 15 in the direction of arrow A in FIG. 1 releases, as is appreciated by those of skill in the art, the tension on wire member 11 and permits brace 14 to pivot in the direction of arrow B. In FIG. 2, latch 15 and brace 14 have been pivoted in the directions of arrow A and B to move brace 14 to the open operative position.

Figure 3:
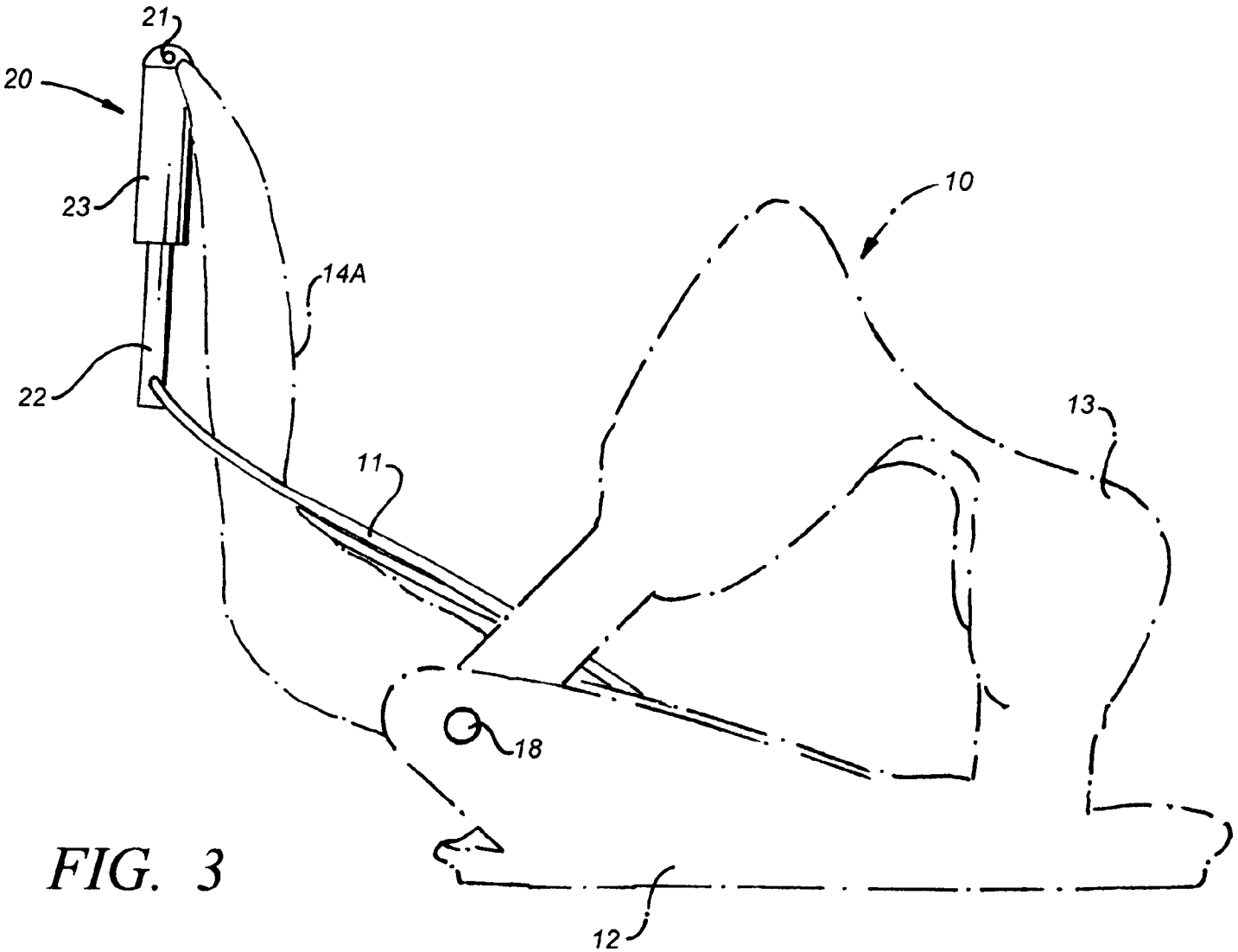
FIG. 3 is a side view of a snow board binding of the general type of FIG. 1 illustrating the binding constructed with a modification in accordance with the principles of the invention.
Figure 4:
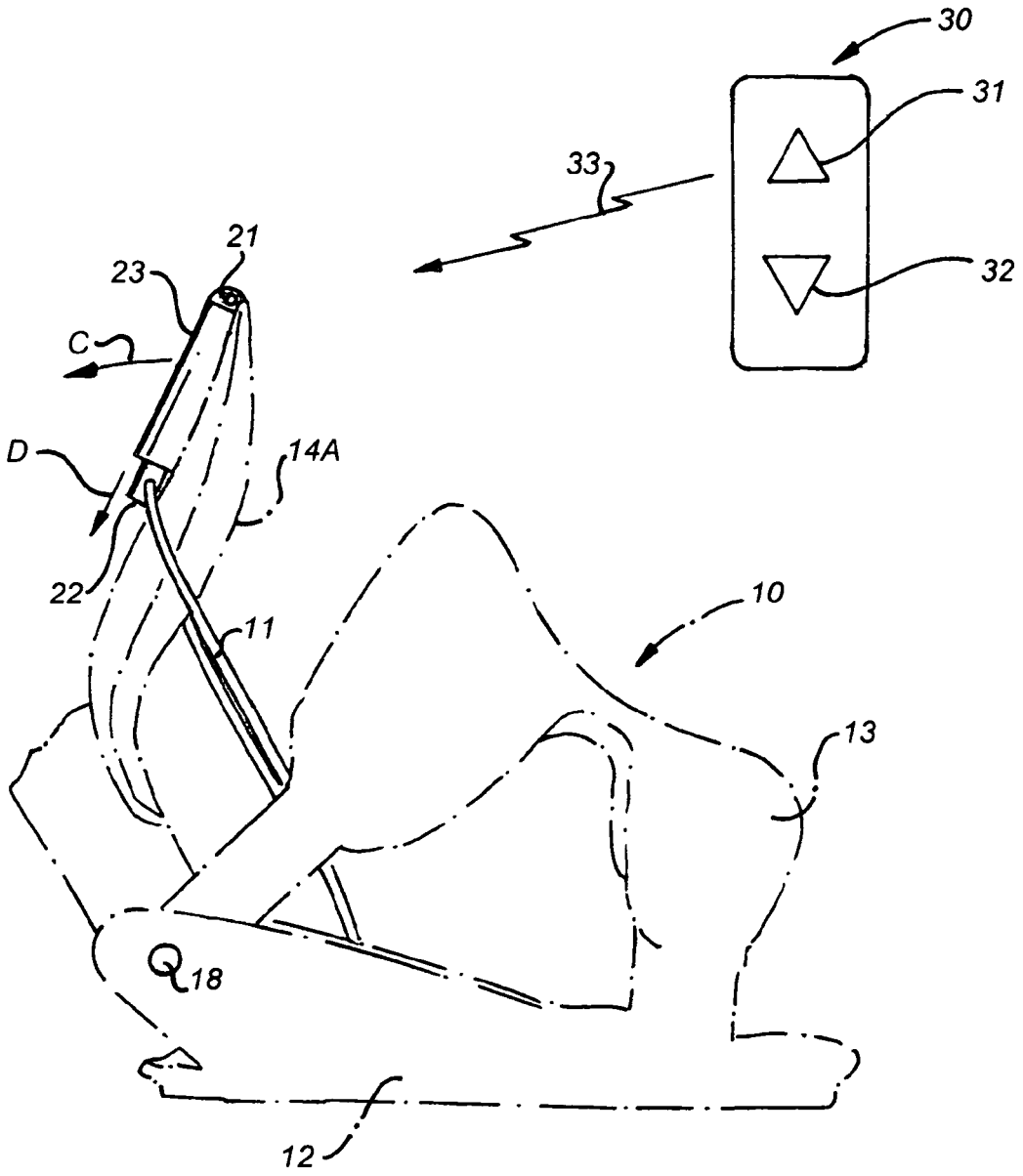
FIG. 4 is a side view of the snow board binding of FIG. 3 illustrating the mode of operation thereof.

One presently preferred embodiment of the binding of the invention is illustrated in FIGS. 3 and 4 and is generally equivalent to the binding of FIGS. 1 and 2, except that latch 15 is removed and replaced by a remotely controlled motorized unit 20 that at its upper end is pivotally attached to brace 14A by a pin 21. Unit 20 includes a motor (not visible) housed in cylindrical body 23. The motor operates to extend and retract tongue 22 from housing 23. The upper end of wire member 11 is pivotally captured by and extends through tongue 22 in the manner illustrated in FIGS. 3 and 4. When button 31 of remote control unit 30 is pressed, unit 30 generates a first a wireless electromagnetic signal and transmits the signal through air to the motor in housing 23 such that the motor functions to extend tongue 22 in the direction of arrow D. When button 32 of control unit 30 is pressed, unit 30 generates a second wireless electromagnetic signal and transmits the signal to the motor in housing 23 such that the motor functions to retract tongue 22 in a direction opposite that of arrow D. The motor can be stopped by pressing either button 31, 32 twice in quick succession. In FIG. 4, brace 14A is in a closed operative position and wire member 11 is tensioned. In FIG. 3, brace 14A in an open operative position and the tension on wire member 11 has been released.

In operation of the apparatus of FIGS. 3 and 4, in FIG. 4, when brace 14A is in the closed operative position, button 31 of unit 30 is depressed to extend tongue 22 in the direction of arrow D and displace brace 14 in the direction of arrow C. When tongue 22 is displaced in the direction of arrow D, wire member 11 is pivotally downwardly displaced. The upper end of member 11 pivots in tongue 22. The lower ends of U-shaped wire member 11 pivot in base 12. In addition, unit 20 initially pivots about pin 21 outwardly away from the upper end of brace 14A. Button 31 is depressed and tongue 22 is extended until brace 14A reaches the open operative position illustrated in FIG. 3. Moving brace 14A from the open operative position of FIG. 3 back to the closed operative position of FIG. 4 is accomplished by depressing button 32 of control unit 30 to retract tongue 22 back into housing 23 to the position illustrated in FIG. 4, and to tension wire member 11 to secure brace 14A in the closed operative position.

As would be appreciated by those of skill in the art, any desired motive power construct can be utilized to move wire member 11 and brace 14A between the closed operative position of FIG. 4 and the open operative position of FIG. 3.

Figure 5:
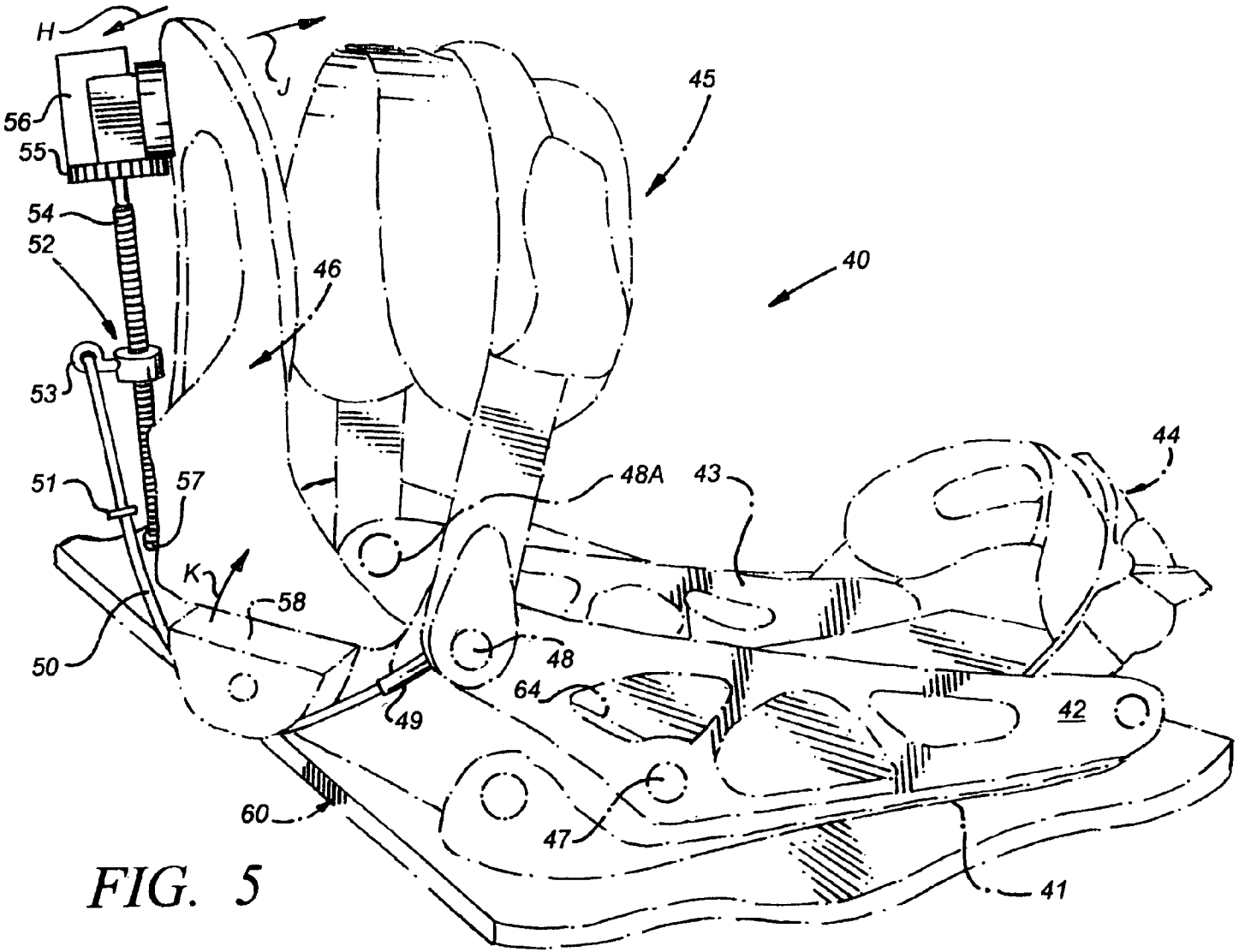
FIG. 5 is a perspective view of a snow board binding constructed in accordance with another embodiment of the invention.
Figure 6:
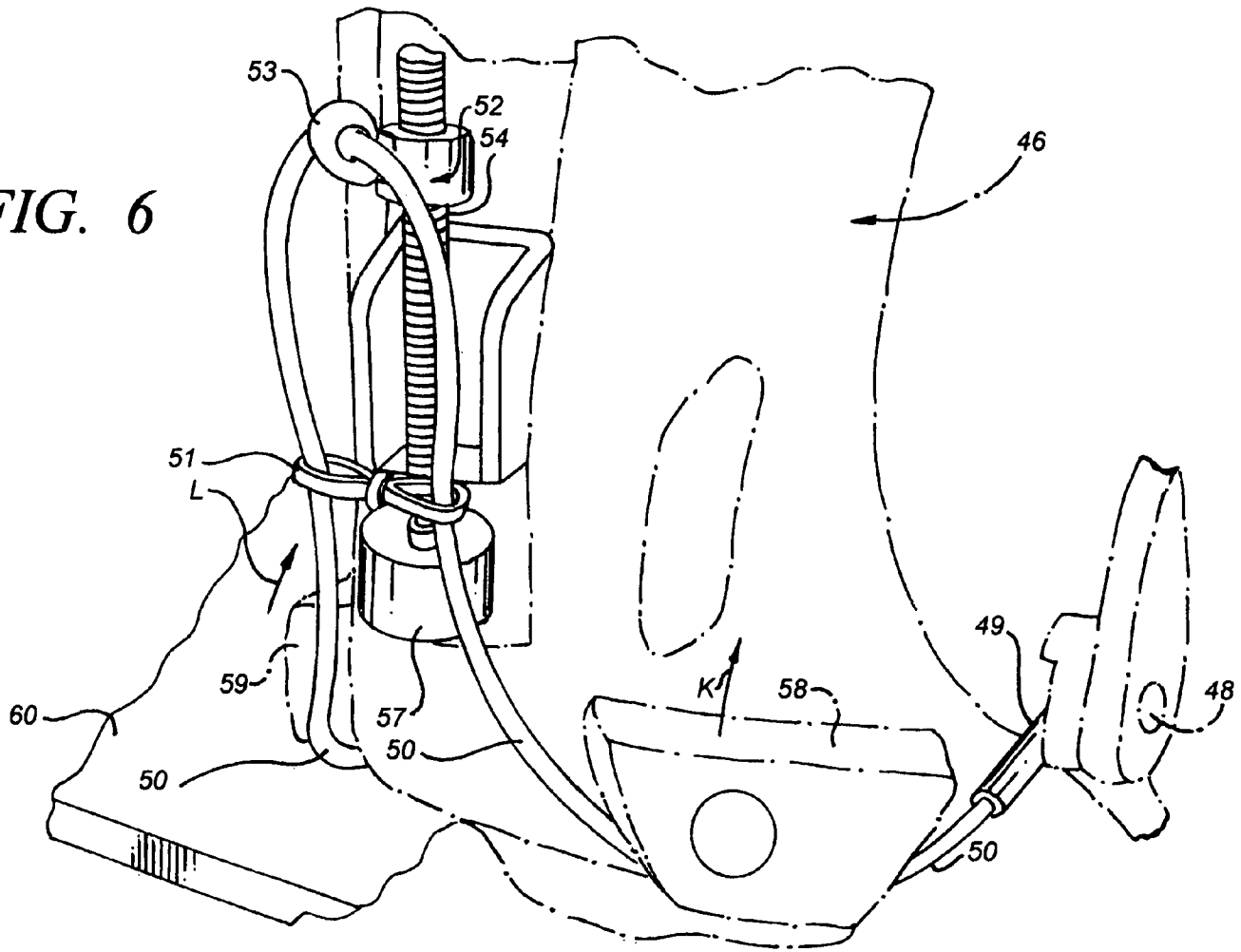
FIG. 6 is a perspective view of a portion of the snow board binding of FIG. 5 illustrating further construction details thereof; and, FIG. 7 is a perspective view of a portion of the snow board binding of FIG. 5 illustrating further construction details thereof.
Figure 7:
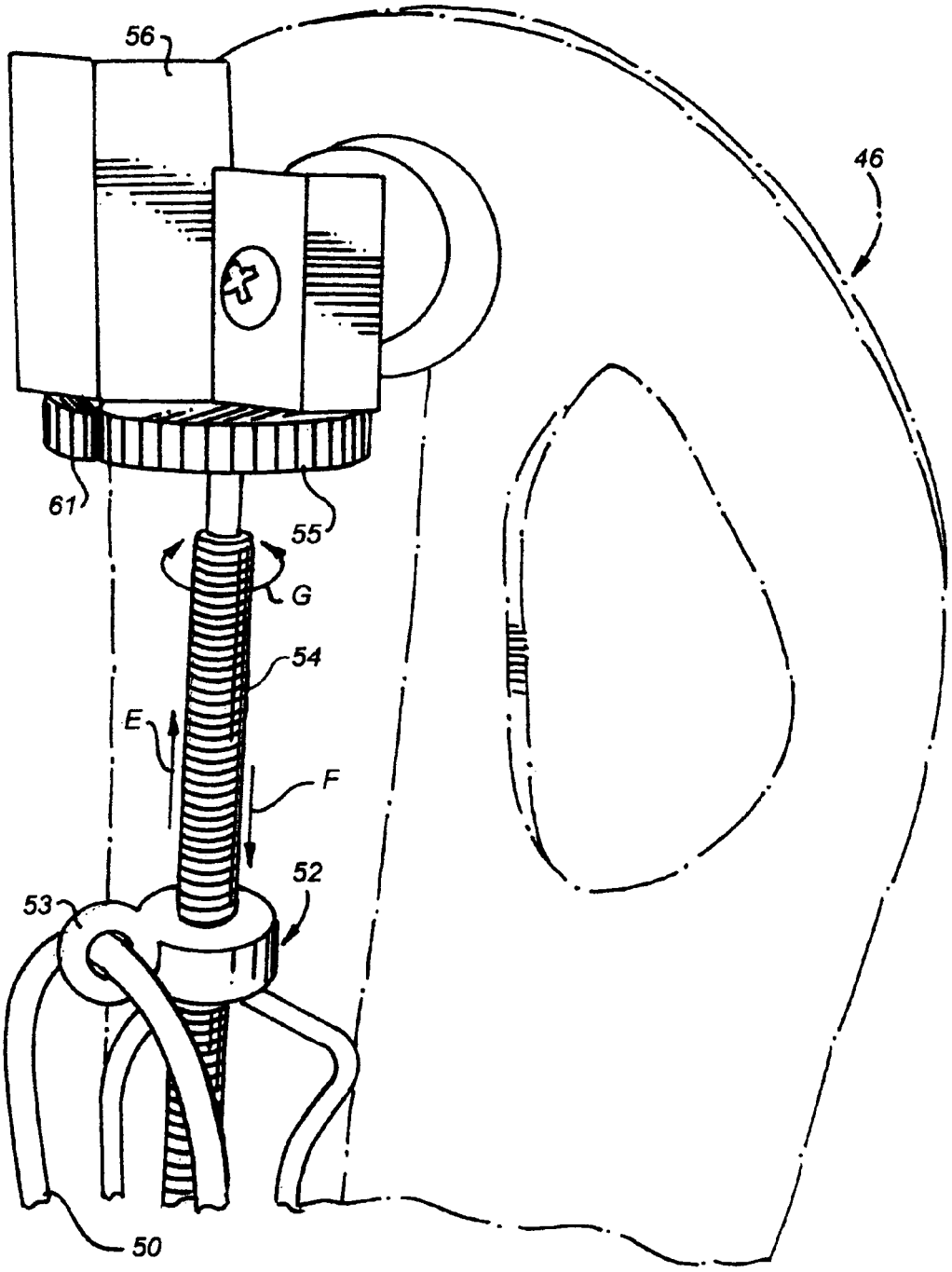

Another preferred embodiment of the invention is illustrated in FIGS. 5 to 7. The binding utilized in this embodiment of the invention is generally indicated in FIG. 5 by reference character 40. Binding 40 is mounted in conventional fashion on a snow board 60. Board 60 includes a longitudinal axis (not shown) which extends from the front toe of board 60 to the rear toe of board 60. Binding 40 is, also in conventional fashion, mounted transverse the longitudinal axis of board 60 such that an individual, after stepping into a pair of bindings 40 on board 60 faces one side of board 60 such that the front of the torso of the individual is generally parallel to the longitudinal axis of board 60.

The binding 40 includes a binding base including a horizontally disposed member 41. The binding base also includes upstanding generally parallel side members 42 and 43.

Binding 40 also includes a first strap 44 attached to the binding base and shaped and dimensioned to extend over and secure the toe of a snow boarding boot which is worn by an individual and is inserted in binding 40.

Binding 40 also includes a second strap 45 which is attached to the binding base and is shaped and dimensioned to extend over and secure the instep of a snow boarding boot which is worn by an individual and is inserted in binding 40. One end of strap 45 is pivotally attached to member 42 of the binding base by pin 48. Similarly, the other end of strap 45 is pivotally attached to member 43 of the binding base by a pin 48A.

Binding 40 also includes an upstanding substantially rigid heel anchor 46. Anchor 46 includes, in conventional fashion, a pair of spaced apart, opposing legs (FIG. 5). Only one of the legs, leg 64, is visible in FIG. 5. The distal end of leg 64 is pivotally attached to member 42 at a pivot pin 47. The distal end of the other leg of anchor 46 is similarly pivotally attached by a pivot pin to member 43 such that the legs 64, and therefore anchor 46, can pivot about the pivot pins and move in the directions indicated by arrows H and J in FIG. 5. Anchor 46 includes at least two operative positions, a first operative locking position and a second operative release position. In the first operative locking position, anchor 46 is substantially vertically oriented, in a position similar to that for brace 14A in FIG. 4. In the second operative release position, anchor 46 is canted rearwardly away from its first operative locking position and is in an orientation similar to brace 14A in FIG. 3.

When anchor 46 is in the first operative locking position, it functions to secure the heel of an individual's snow boarding boot in binding 40. When anchor 46 is in the second operative release position, the heel of a snow boarding boot worn by an individual is free to be removed from binding 40.

Binding 40 also includes generally U-shaped cable 50. Cable 50 includes a pair of ends 49. One end 49 is fixedly pivotally attached to pivot pin 48. The other end of cable 50 is pivotally fixedly attached to pivot pin 48A. As can be seen in FIG. 5, a first portion of cable 50 slidably extends beneath a first guide member 58. As can be seen in FIG. 6, a second portion of cable 50 slidably extends beneath a second guide member 59. Guide members 58 and 59 are identical in shape and dimension.

Tie 51 slidably restrains and guides cable 50. Cable 50 slidably extends through eyelet 53 fixedly attached to nut 52. An internally threaded aperture in nut 52 rotatably receives externally threaded shaft 54. When shaft 54 is rotated in the manner indicated by arrows G in FIG. 7, nut 52, and therefore eyelet 53, moves up or down shaft 54 in the manner indicated by arrows E and F in FIG. 7. Shaft 54 is free to rotate in the manner described; however, shaft 54 is otherwise mounted in fixed position on anchor 46. The lower end of shaft 54 is rotatably secured in cylindrical member 57 (FIG. 6). Member 57 is fixedly mounted on anchor 46. The upper end of shaft 54 is fixedly secured to gear 55. Gear 61 (FIG. 7) is driven by motor assembly 56 to rotate gear 55, and therefore shaft 54, in the directions indicated by arrows G. Motor assembly 56 is fixedly secured to anchor 46. When motor assembly 56 turns gear 61 is a first direction, gear 55 and shaft 54 rotate in a first one of the directions indicated by arrows G, and nut 52 moves down shaft 54 in the direction indicated by arrow F. When motor assembly 56 turns gear 61 in a second direction opposite the first direction, gear 55 and shaft 54 rotate in a second one of the directions indicated by arrows G, and nut 52 moves up shaft 54 in the direction indicated by arrow E.

Nut 52 moves up shaft 54 in the direction of arrow E when anchor 46 is being moved from the second operative release position to the first operative locking position. When nut 52 moves up shaft 54, eyelet 53 displaces the intermediate portion of cable 50 upwardly and, accordingly, tensions cable 50 such that anchor 46 moves toward the first operative locking position.

Nut 52 moves down shaft 54 in the direction of arrow F when anchor 46 is being moved from the first operative locking position to the second operative release position. When nut 52 moves downwardly along shaft 54, anchor 46 pivots in the direction of arrow H and releases tension on cable 50.

When nut 52 moves up shaft 54 in the direction of arrow E (FIG. 7), anchor 46 is being moved from the second operative release position to the first operative locking position. When nut 52 moves upwardly along shaft 54, anchor pivots in the direction of arrow J and tensions cable 50. The material utilized to fabricate cable 50 can vary as desired, but presently preferably comprises a metal(s). Cable 50 is also presently preferably substantially rigid so that in use the length of cable 50 stays relatively constant. It is, however, possible to fabricate cable 50 from a resilient rubber band-like material which in use can be tensioned sufficiently to cause anchor 46 to move from its second operative release position to its first operative locking position.

Motor assembly 56 is powered by batteries (not shown) mounted therein, although any desired power source or apparatus can be utilized to provide power to operate assembly 56. Motor assembly 56 can, if desired, include a switch(es) to turn assembly 56 on and off to rotate shaft 54 in the desired direction to move nut 52 up or down along shaft 54. It is, however, presently preferred that a remote control unit comparable to unit 30 be utilized to turn motor assembly 56 on and off, and, to "close" anchor 46 (by moving nut 52 in the direction of arrow E) or "open" anchor 46 (by moving nut 52 in the direction of arrow F).

As would be appreciated by those of skill in the art, the construction of the apparatus of the invention can vary as desired as long as the apparatus functions to displace the intermediate portion of cable 50 such that the tension on cable 50 is increased and decreased such that anchor 46 is moved between its first operative locking position and its second operative release position.

The motor assembly 56, shaft 54, nut 52, etc. can be covered or enclosed by a protective housing or other desired structure.

In another embodiment of the invention, the shaft 54, nut 52, and motor assembly 56 are produced to be retrofit on an existing binding. For example, the binding of FIG. 5 is comparable to an existing K2 binding, except that the manually operated latch on the original binding has been removed and replaced by motor assembly 56, shaft 54 and nut 52 (including eyelet 53). The manually operated latch on the original binding is used to generate and increase tension on cable 50 to close anchor 46 (i.e., move anchor 46 to its first operative locking position) and to release and decrease the tension on cable 50 to open anchor 46 (i.e., to move anchor 46 to its second operative release position). After the manually operated latch on the original binding is removed, the shaft 54, nut 52, motor assembly 56 and other associated fastening apparatus, if any, are mounted on anchor 46 in the manner illustrated in FIGS. 5 to 7.

In another embodiment of the invention, the shaft 54, nut 52, and motor assembly 56 are utilized to open and close other bindings or apparatus.

Having described my invention in such terms as to enable those of skill in the art to make and use the invention, and having described the presently preferred embodiments thereof, I claim:

1. A snow board comprising (a) an elongate board shaped and dimensioned to slide over snow and having a longitudinal axis;

(b) at least one binding mounted transverse said longitudinal axis and including (i) a base;

(ii) a first strap attached to said base and shaped and dimensioned to extend over and secure the toe of a boot worn by an individual, (iii) a second strap attached to said base and shaped and dimensioned to extend over and secure the instep of a boot worn by an individual, (iv) a heel anchor pivotally connected to said base and having at least two operative positions, a first operative locking position securing in said binding the heel of a boot worn by an individual, and a second operative release position permitting the heel of a boot worn by an individual to be removed from said binding, (v) a generally U-shaped cable including an intermediate portion and including a pair of ends each pivotally connected to said base, (vi) control apparatus fixedly mounted on said heel anchor to engage said cable and move said cable between at least two operative positions, a primary upwardly displaced operative position to move pivotally said heel anchor to said first operative locking position, and a secondary downwardly displaced operative position to move pivotally said heel anchor to said second operative release position, said control apparatus including a displacement member engaging said intermediate portion of said cable and including apparatus to move said displacement member toward and away from said base of said binding, (vii) a U-shaped wire member, (viii) a motor to provide motive power to move said heel anchor between a first closed operative position in which said wire member is tensioned and second open operative position in which said wire member is not tensioned.

* * * * *